US007942603B2

(12) United States Patent
Miller

(10) Patent No.: US 7,942,603 B2
(45) Date of Patent: May 17, 2011

(54) SPEED SENSITIVE TRAFFIC CONTROL DEVICE

(76) Inventor: William R. Miller, Allison Park, PA (US)

( * ) Notice: Subject to any disclaimer, the term of this patent is extended or adjusted under 35 U.S.C. 154(b) by 54 days.

(21) Appl. No.: 12/424,773

(22) Filed: Apr. 16, 2009

(65) Prior Publication Data

US 2009/0285630 A1 Nov. 19, 2009

Related U.S. Application Data

(60) Provisional application No. 61/045,356, filed on Apr. 16, 2008.

(51) Int. Cl.
*E01F 9/047* (2006.01)

(52) U.S. Cl. ..... 404/12; 404/16

(58) Field of Classification Search ..... 404/6, 9–11; 256/13.1

See application file for complete search history.

(56) References Cited

U.S. PATENT DOCUMENTS

| | | | | |
|---|---|---|---|---|
| 4,362,424 | A * | 12/1982 | Barber | 404/6 |
| 5,843,335 | A * | 12/1998 | Kurono et al. | 516/100 |
| 2004/0173422 | A1* | 9/2004 | Deshmukh et al. | 188/267.2 |
| 2004/0186224 | A1* | 9/2004 | Minemura et al. | 524/588 |
| 2007/0107778 | A1* | 5/2007 | Bettin et al. | 137/13 |
| 2007/0149079 | A1* | 6/2007 | Vito et al. | 442/181 |
| 2009/0286910 | A1* | 11/2009 | Bloomfield | 524/269 |
| 2010/0202830 | A1* | 8/2010 | Aguilera Galeote | 404/10 |
| 2010/0221521 | A1* | 9/2010 | Wagner et al. | 428/315.5 |

FOREIGN PATENT DOCUMENTS

WO WO 2009/053946 A2 * 10/2008

* cited by examiner

*Primary Examiner* — Raymond W Addie
(74) *Attorney, Agent, or Firm* — The Webb Law Firm

(57) ABSTRACT

A traffic control device includes a shell body and at least one receptacle located in the shell body. The receptacle includes a dilatant material.

15 Claims, 2 Drawing Sheets

SPEED SENSITIVE TRAFFIC CONTROL DEVICE

CROSS REFERENCE TO RELATED APPLICATION

This application claims priority to U.S. Application Ser. No. 61/045,356, filed Apr. 16, 2008, herein incorporated by reference in its entirety.

BACKGROUND OF THE INVENTION

1. Field of the Invention

This invention relates generally to traffic control devices and, in one particular embodiment, to a traffic control device sensitive to the speed of a vehicle.

2. Description of the Current Technology

Conventional devices are known to help slow down the speed of traffic in selected areas. For example, conventional "speed bumps" or "rumble strips" are used in such places as school zones, parking lots, construction zones, hospital zones and similar areas where it is desired to control or reduce the speed of vehicles for the safety of pedestrians.

A conventional speed bump usually consists of a concrete or asphalt hump formed in the road. Drivers must slow down when driving over these speed bumps to prevent damage to their vehicle. However, even if travelling at the posted speed limit or below, these conventional speed bumps can take a toll on a vehicle's mechanical components, such as the shock absorbers and steering system. Additionally, these conventional speed bumps are very heavy and, once in place, are typically permanent fixtures on the roadway. In order to remove a conventional speed bump, the speed bump must be broken up and the roadway repaired where the speed bump used to be. Additionally, these conventional speed bumps require maintenance to repair cracks and breaks caused by heavy traffic volume.

Therefore, it would be advantageous to provide a traffic control device that reduces or eliminates at least some of the problems associated with conventional speed bumps.

SUMMARY OF THE INVENTION

A traffic control device of the invention comprises a shell body and at least one receptacle located in the shell body. The receptacle includes a dilatant material.

Another traffic control device of the invention comprises a compliant material that stiffens or hardens in response to applied pressure. The compliant material can be located in or encapsulated in another material, such as but not limited to, a flexible housing. The compliant material can be a dilatant material.

BRIEF DESCRIPTION OF THE DRAWINGS

The invention will be described with reference to the following drawing figures wherein like reference numbers identified like parts throughout.

DESCRIPTION OF THE PREFERRED EMBODIMENTS

The invention will be described with reference to use in a conventional speed bump configuration. However, it is to be understood that the invention is not limited to use with speed bumps but could be used in other traffic control or regulating capacities, such as but not limited to rumble strips and the like.

Figure 1:
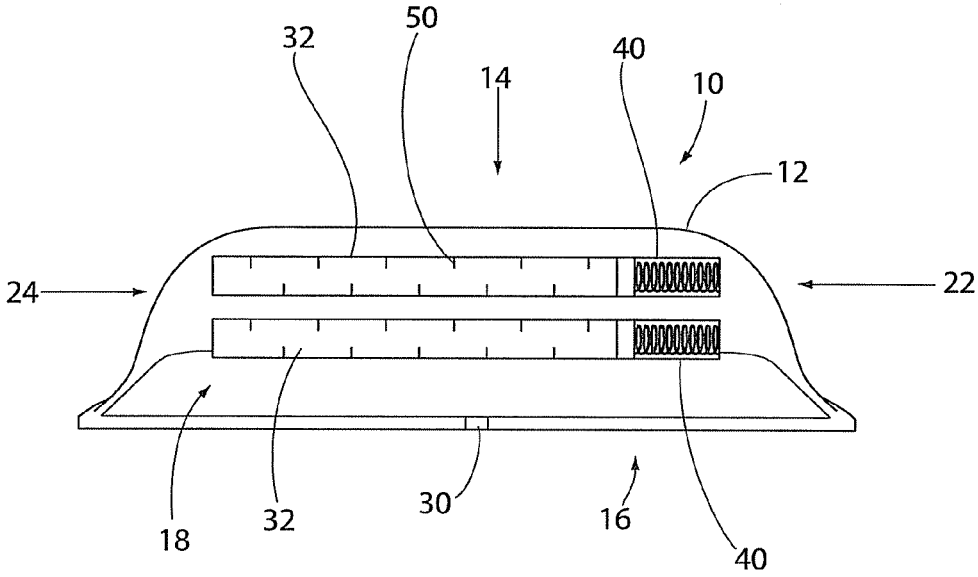
FIG. 1 is a side view (not to scale) of a traffic control device of the invention in the form of a speed bump showing the interior components.
Figure 2:
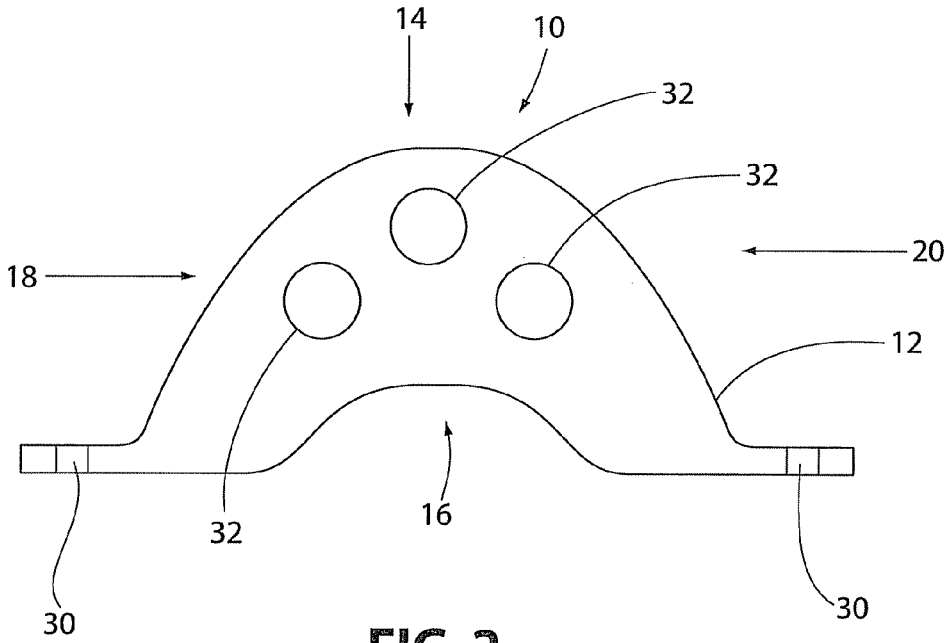
FIG. 2 is an end view (not to scale) of the device of FIG. 1.

A speed-sensitive traffic control device 10 of the invention is shown in FIGS. 1 and 2. The device 10 includes an outer shell 12 having a top 14, a bottom 16, a front side 18, a rear side 20, and a pair of opposed ends 22,24. The shell 12 may include one or more fastening holes 30 so that the device 10 can be either permanently or replaceably mounted to a roadway or other surface such as by bolts, screws, or other conventional devices. The shell 12 can be formed of any conventional material, such as but not limited to flexible or resilient materials such as polymeric materials or rubber materials.

The shell 12 encloses one or more housings or receivers 32 containing a compliant material, that reversibly hardens or stiffens in response to an applied pressure and goes back to its original form when the pressure is relieved, such as a dilatant material. In one embodiment, the interior of the shell 12 can be hollow and the dilatant material provided in one or more hollow spaces inside the shell 12. However, in the embodiment shown in FIGS. 1 and 2, the receivers 32 are in the form of elongated, hollow, flexible tubes having closed ends. The receivers 32 can be of any desired shape but in the illustrated embodiment are shown as cylindrical tubes. The tubes may be of any material and, in one non-limiting embodiment, are formed of a flexible material, such as a polymeric or rubber material.

In one non-limiting embodiment, the tubes include an expansion device 40 to allow for the expansion of the dilatant material when a vehicle runs over the device 10, as will be explained in greater detail below. This expansion device 40 can be of any configuration, such as but not limited to a conventional expansion bladder or similar device. The expansion bladder can be, for example, a conventional flexible pouch or bag in flow communication with the interior of the receiver 32. Alternatively, the expansion bladder can be formed simply by a flexible end-portion of the receiver 32.

Figure 3A:
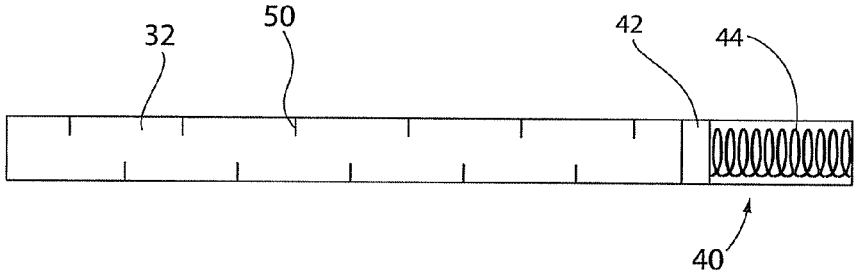
FIG. 3 shows an expansion device of the invention (not to scale) in (a) first (non-expanded) state and (b) a second (expanded) state.
Figure 3B:
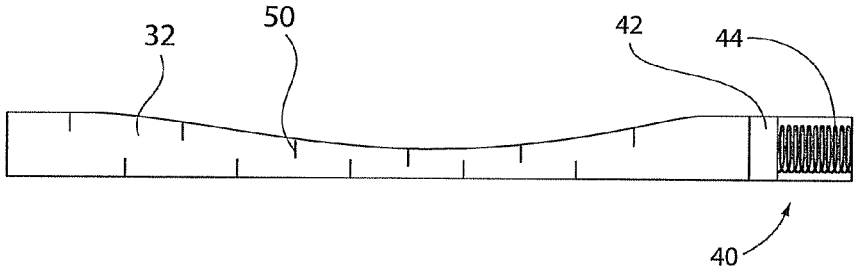

In the illustrated embodiment, the expansion device 40 is shown as a piston device having a piston 42 movable in the tube and connected to a spring 44 or similar biasing member. Under normal conditions, the spring 44 biases the piston 42 to a first position in FIG. 3(*a*). When the shell 12 is compressed (such as when a vehicle runs over the device 10), the tubes are also compressed and the pressure of the dilatant material in the tubes pushes against the piston 42 and compresses the spring 44, as shown in FIG. 3(*b*) and as described in detail below. In one non-limiting embodiment, the receivers 32 can include a flow restriction device 50 to enhance the function of the dilatant material. For example, FIGS. 3(*a*) and 3(*b*) illustrate the flow restriction device 50 in the form of baffles within the tubes. Of course, other types of flow restrictors could be used. For example, a porous material (such as a porous foam) could be placed within the tubes to restrict the movement of the dilatant material.

Dilatant material is also sometimes referred to as a shear thickening fluid or a non-newtonian fluid. That is, below a critical shear rate the material acts like a fluid but above a critical shear rate the material acts like a solid. A dilatant material is typically a material in which the viscosity increases with the rate of shear. Examples of such dilatant materials include the fluid used in the torque converters of some conventional all wheel drive vehicles. Other dilatant materials are formed by dissolving particulate matter in a carrier fluid. One example is formed by placing silica particles in a fluid, such as polyethylene glycol. At high shear rates, the hydrodynamic forces overcome the repulsive interparticle forces and silica hydroclusters form which increase the viscosity of the fluid. The shear rate at which the viscosity increases and the rate of viscosity increase can be controlled by adjusting the amount of colloidal silica particles in the fluid. Other known dilatant materials include dissolving one or more water soluble polymers (such as KLUCEL® polymers commercially available from Hercules Incorporated) in an aqueous solution. In another non-limiting embodiment, an impact hardening foam (such as manufactured by d30) can be used with the dilatant material.

Operation of the traffic control device 10 will now be described.

Figure 4:
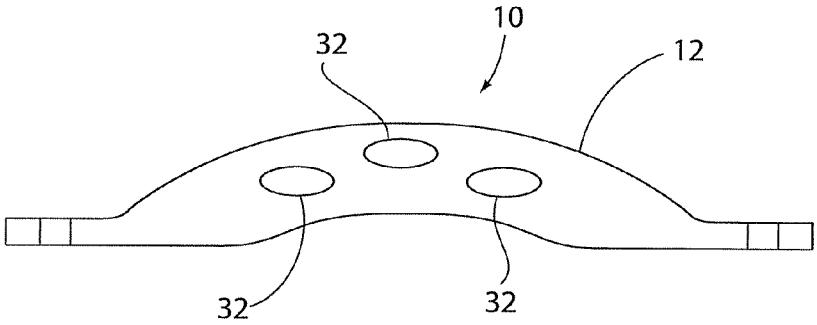
FIG. 4 shows the device of FIG. 2 (not to scale) in a compressed state after contact with a vehicle.

The device 10 can be either permanently or temporarily mounted at a desired location, such as in a street or roadway. The dilatant material in the tubes can be selected based on a desired shear rate (which can correspond to a predetermined vehicle speed). When a vehicle rolls over the device 10 below the predetermined speed (i.e. below the critical shear rate of the dilatant material), the dilatant material remains in fluid form and the weight of the vehicle compresses the shell 12 and the tubes, thus pushing the dilatant material (fluid) against the piston 42 and moving the piston 42 from the position shown in FIG. 3(*a*) to the position shown in FIG. 3(*b*). The shell 12 and tubes are compressed as shown in FIG. 4. When the vehicle has passed over the device 10, the shell 12 returns to its initial shape and the spring 44 pushes against the piston 42 to push the dilatant material back into the tubes (which also return to their original shape). Thus, below the critical shear rate, little impact is felt by the driver and little stress placed on the mechanical components of the vehicle. Therefore, if the vehicle is traveling under the selected speed limit (and providing a shear rate less than the critical shear rate), the vehicle will not suffer the hard and jolting impact as would occur with a conventional speed bump.

However, in the event a vehicle impacts the control device 10 at a speed above the predetermined speed (that is, providing a shear rate above the critical shear rate), the viscosity of the dilatant material increases (i.e. the dilatant material acts as a solid) and the control device 10 substantially retains the speed bump shape shown in FIGS. 1 and 2. The control device 10 in this scenario acts similarly to a conventional speed bump and the driver of the vehicle exceeding the selected speed limit will experience a bump or jolt as would be felt with a conventional speed bump.

It will be readily appreciated by those skilled in the art that modifications may be made to the invention without departing from the concepts disclosed in the foregoing description. For example, in one embodiment the shell 12 can be eliminated and just one or more of the receivers 32 containing the dilatant material used as the traffic control device. Accordingly, the particular embodiments described in detail herein are illustrative only and are not limiting to the scope of the invention, which is to be given the full breadth of the appended claims and any and all equivalents thereof.

The invention claimed is:

1. A traffic control device, comprising:

a shell body;

at least one receptacle located in the shell body; and a dilatant material located in the recepticle, wherein the dilatant material has a critical shear rate corresponding to a predetermined vehicle speed such that the dilatant material acts as a fluid below the predetermined vehicle speed and acts as a solid above the predetermined vehicle speed.

2. The device of claim 1, where the receptacle comprises at least one cylindrical tube having closed ends.

3. The device of claim 2, further including an expansion device in flow communication with the at least one tube.

4. The device of claim 3, wherein the expansion device comprises a spring-biased piston.

5. The device of claim 3, wherein the expansion device comprises an expansion bladder.

6. The device of claim 1, including a plurality of flow restrictors located in the recepticle.

7. The device of claim 1, comprising a plurality of recepticles, wherein each recepticle comprises an elongated, flexible tube, and further comprising a plurality of baffles located in the recepticles.

8. A traffic control device, comprising:

a housing; and a compliant material located in the housing, wherein the compliant material reversibly stiffens in response to applied pressure, wherein the compliant material has a critical shear rate corresponding to a predetermined vehicle speed such that the compliant material acts as a fluid below the predetermined vehicle speed and acts as a solid above the predetermined vehicle speed.

9. The device of claim 8, wherein the housing is configured to hold the compliant material in a desired shape.

10. The device of claim 8, wherein the housing is configured to force the compliant material back into an original shape after the pressure has been relieved.

11. The device of claim 8, wherein the housing is located in a supporting means.

12. The device of claim 11, wherein the supporting means comprises a shell.

13. A method of controlling traffic speed, comprising:

providing a traffic control device comprising a housing containing a dilatant material, wherein the dilatant material is selected to have a critical shear rate corresponding to a predetermined vehicle speed such that below the predetermined vehicle speed the dilatant material acts as a fluid but above the predetermined vehicle speed the dilatant material acts as a solid; and positioning the housing on a roadway.

14. The device of claim 8, including a plurality of flow restrictors located in the housing.

15. The device of claim 8, comprising a plurality of housing located in a shell, with a plurality of baffles located in the housing.

* * * * *